US009915498B1

(12) United States Patent
Spuhr

(10) Patent No.: US 9,915,498 B1
(45) Date of Patent: Mar. 13, 2018

(54) LENGTH ADJUSTABLE BUTT PAD ASSEMBLY

(71) Applicant: Spuhr i Dalby AB, Löddeköpinge (SE)

(72) Inventor: Håkan Spuhr, Dalby (SE)

(73) Assignee: Spuhr | Dalby AB, Löddeköpinge (SE)

( * ) Notice: Subject to any disclaimer, the term of this patent is extended or adjusted under 35 U.S.C. 154(b) by 0 days.

(21) Appl. No.: 15/407,077

(22) Filed: Jan. 16, 2017

(51) Int. Cl.
*F41C 23/00* (2006.01)
*F41C 23/14* (2006.01)
*F41C 23/20* (2006.01)

(52) U.S. Cl.
CPC ..... *F41C 23/14* (2013.01); *F41C 23/20* (2013.01)

(58) Field of Classification Search
CPC ..... F41C 23/00; F41C 23/04; F41C 23/12; F41C 23/14; F41C 23/20
See application file for complete search history.

(56) References Cited

U.S. PATENT DOCUMENTS

| | | | | |
|---|---|---|---|---|
| 3,137,958 | A * | 6/1964 | Lewis | F41C 23/14 42/73 |
| 3,267,601 | A * | 8/1966 | Roy | F41C 23/14 42/73 |
| 3,324,588 | A * | 6/1967 | Gilbert | F41C 23/00 42/71.01 |
| 3,442,042 | A * | 5/1969 | Van Tyle Gilbert | F41C 23/00 42/71.01 |
| 4,663,877 | A | 5/1987 | Bragg | |
| 5,367,812 | A | 11/1994 | Lautrec | |
| 5,392,553 | A | 2/1995 | Carey | |
| 5,711,102 | A | 1/1998 | Plaster et al. | |
| 8,720,099 | B1 * | 5/2014 | Sisk | F41C 23/14 42/73 |
| 2002/0050088 | A1 | 5/2002 | Sharp | |
| 2008/0028662 | A1 | 2/2008 | Abraham et al. | |
| 2010/0212205 | A1 * | 8/2010 | Nill | F41C 23/14 42/73 |
| 2011/0138668 | A1 | 6/2011 | Thomas | |
| 2014/0109453 | A1 | 4/2014 | Paquette | |
| 2015/0338186 | A1 | 11/2015 | Hopkins | |
| 2016/0061559 | A1 | 3/2016 | Wood et al. | |
| 2016/0202016 | A1 | 7/2016 | Mather et al. | |

FOREIGN PATENT DOCUMENTS

| | | | | |
|---|---|---|---|---|
| CN | 204535547 | U | 8/2015 | |
| DE | 3743092 | A1 * | 7/1988 | F41C 23/10 |
| DE | 102004027123 | B3 * | 8/2005 | F41C 23/04 |
| DE | 102008019229 | A1 | 8/2009 | |
| EP | 0940646 | B1 | 9/1999 | |
| WO | 2014035831 | A1 | 3/2014 | |
| WO | 2014078462 | A1 | 5/2014 | |
| WO | WO 2017017560 | A1 * | 2/2017 | F41C 23/04 |

* cited by examiner

*Primary Examiner* — Gabriel J. Klein
(74) *Attorney, Agent, or Firm* — Eversheds Sutherland (US) LLP

(57) ABSTRACT

A length adjustable butt pad assembly for a firearm is shown and described. The length adjustable butt pad assembly includes a butt plate having an elongated butt plate shaft and a butt plate base. The butt plate base includes an elongated mounting tube extending in a horizontal direction and receives the butt plate shaft. The elongated butt plate shaft is rotatable in the mounting tube between a first locked position and a second released position. The second released position allows for an axial displacement of the elongated butt plate shaft between at least two fixed locations.

12 Claims, 4 Drawing Sheets

LENGTH ADJUSTABLE BUTT PAD ASSEMBLY

FIELD OF DISCLOSURE

The disclosure relates to firearms and more particularly to features of a length adjustable firearm butt pad assembly.

BACKGROUND

Firearm stocks are typically fixed in a single position, and the end of the stock (normally a butt pad) is designed to fit into a user's shoulder pocket. Because the stock is fixed, the user must acclimate to the position of the stock. However, there can be significant variation in the shape and size of a user's shoulder. Such variation can result in discomfort, inaccurate, and unsafe shooting positions. Moreover, a user's clothing and load out can significantly vary from one situation to another. Although available contemporary stock assemblies provide for adjusting an aspect of the stock, making the adjustment normally requires manipulating one or more unlocking one or more elements, and cannot be done without a special tool or under duress. As a result, the stock position cannot be easily adjusted under duress. What is needed is an ability for a firearm user to easily and conveniently adjust the position of the end of the stock in horizontal position of the buttstock.

SUMMARY

It is to be understood that both the following general description and the following detailed description are exemplary and explanatory only and are not restrictive, as claimed. Provided is a length adjustable butt pad assembly for a firearm. Additional advantages will be set forth in part in the description which follows or may be learned by practice. The advantages will be realized and attained by means of the elements and combinations particularly pointed out in the appended claims.

BRIEF DESCRIPTION OF THE DRAWINGS

The accompanying drawings, which are incorporated in and constitute a part of this specification, illustrate embodiments and together with the description, serve to explain the principles of the novel butt pad.

All drawings are schematic and not necessarily to scale. Parts given a reference numerical designation in one figure may be considered to be the same parts where they appear in other figures without a numerical designation for brevity unless specifically labeled with a different part number and/or described herein. Parts described herein with respect to certain figures may also appear in other figures in which they may be numbered or unnumbered unless otherwise noted herein.

DESCRIPTION

The features and benefits of the novel butt pad are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

As used herein the singular forms "a," "an," and "the" include both singular and plural referents unless the context clearly dictates otherwise. Values expressed as approximations, by use of antecedents such as "about" or "approximately," shall include reasonable variations from the referenced values. If such approximate values are included with ranges, not only are the endpoints considered approximations, the magnitude of the range shall also be considered an approximation. Lists are to be considered exemplary and not restricted or limited to the elements comprising the list or to the order in which the elements have been listed unless the context clearly dictates otherwise.

Throughout the specification and claims of this disclosure, the following words have the meaning that is set forth: "comprise" and variations of the word, such as "comprising" and "comprises," mean including but not limited to, and are not intended to exclude, for example, other additives, components, integers or steps. "Exemplary" means "an example of", but not essential, necessary, or restricted or limited to, nor does it convey an indication of a preferred or ideal embodiment. "Include" and variations of the word, such as "including" are not intended to mean something that is restricted or limited to what is indicated as being included, or to exclude what is not indicated. "May" means something that is permissive but not restrictive or limiting. "Optional" or "optionally" means something that may or may not be included without changing the result or what is being described. "Prefer" and variations of the word such as "preferred" or "preferably" mean something that is exemplary and more ideal, but not required. "Such as" means something that is exemplary.

Figure 1:
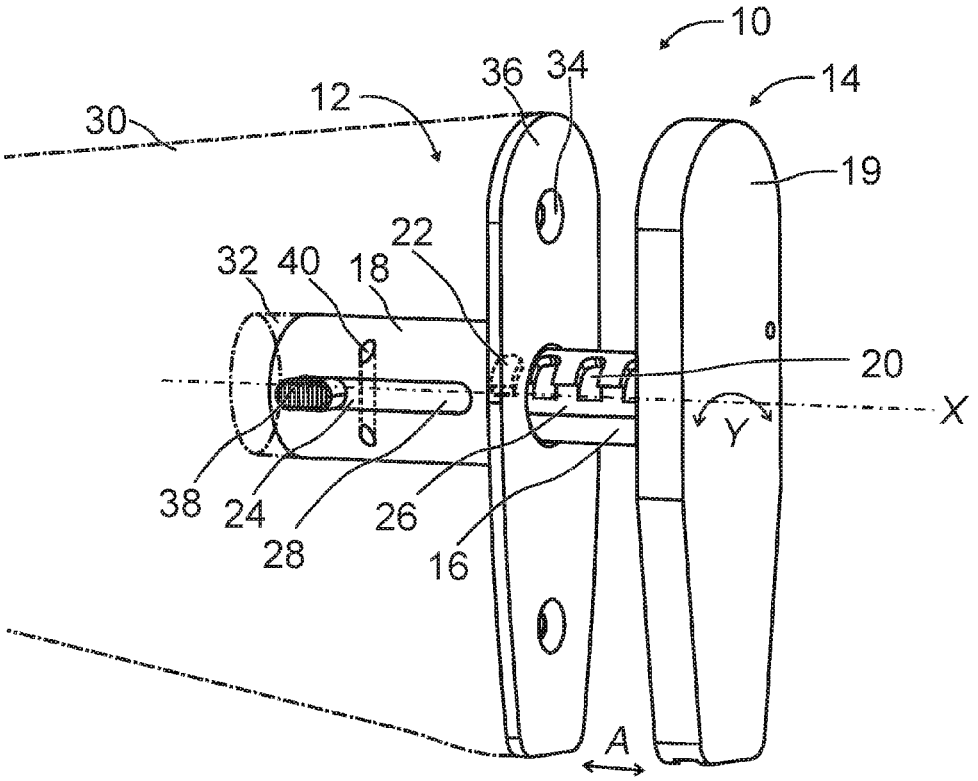
FIG. 1 is a schematic perspective view showing the butt pad assembly in extended position.

The embodiment of an adjustable butt pad assembly 10 for a firearm in accordance with the example embodiment shown in FIG. 1 comprises a butt plate base 12 and a butt plate 14. Butt plate 14 comprises a butt plate shaft 16 fitting inside a mounting tube 18 of butt plate base 12, and a butt plate rear part 19. Butt plate shaft 16 can be adjusted in a longitudinal direction of mounting tube 18, so as to displace butt plate 14 into different horizontal locations as indicated at arrow A. Different horizontal locations are determined by a plurality of locking notches 20 formed in the butt plate shaft 16 and at least one internal and radially extending locking lug 22 in mounting tube 18. Butt plate shaft 16 and mounting tube 18 extend along a common axis as depicted by X. Common axis X corresponds to the horizontal direction.

Figure 6:
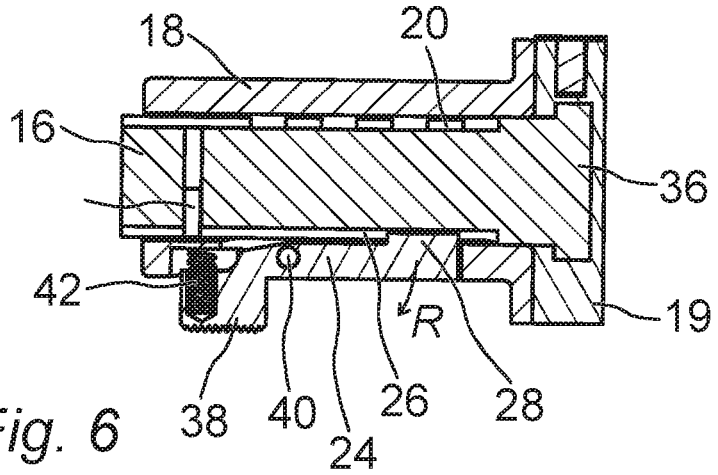
FIG. 6 is a cross-section view of the butt pad assembly with a spring-biased locking lever in locked position taken along line VI-VI in FIG. 5.

Butt plate 14 can be rotated as depicted by arrow Y around common axis X between a first locked position as shown in FIG. 1 and a second released position in which displacement of butt plate shaft 16 in the direction of common axis X is possible. Rotation of butt plate 14 is possible after releasing a locking mechanism. In various embodiments locking mechanism comprises a spring-biased locking lever 24. The locking mechanism normally is in a secured position as shown in FIG. 1 preventing rotation of butt plate 14. In the secured position, a head 28 of spring-biased locking lever 24, c.f. FIG. 6, is forced into engagement in an axially extending groove 26 formed in butt plate shaft 16. The locking mechanism is released by pressing a knob 38 against a spring resulting in a rotating movement around a pin 40. When the spring-biased locking lever 24 is rotated around pin 40 head 28 will move out of axially extending groove 26 and a rotating movement of butt plate shaft 16 is allowed.

Butt plate base 12 is selectively attached to a stock 30 of a firearm, such as a rifle. In various embodiments mounting tube 18 is inserted into a cavity 32 in the stock 30. In the embodiment shown in FIG. 1, butt plate 12 is secured in position by screws (not shown) through holes 34 in a plate 36 engaging an end section of the stock 30. Plate 36 extends substantially perpendicular to the mounting tube 18.

Figure 2:
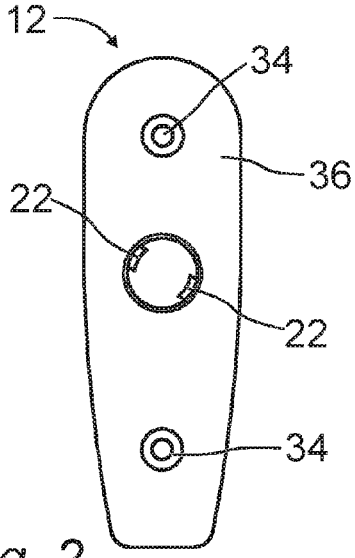
FIG. 2 is a rear view of a butt plate base of one embodiment of a length adjustable butt pad assembly.

As shown in FIG. 2 of an end section of butt plate base 12 and plate 36 two internal and radially extending lugs 22 are provided in diagonal positions. Internal and radially extending lugs 22 engage in locking notches 20 shown in more detail in FIG. 3. In various embodiments locking notches 20 also can be provided in diagonal positions on butt plate shaft 16 to interact with internal and radially extending lugs 22 on opposite sides of butt plate shaft 16. The length of butt plate shaft 16 and the number of locking notches 20 determine the number of possible fixed locations of butt plate 14 in the axial direction X. FIG. 2 shows an embodiment with four locking notches 20.

Figure 3:
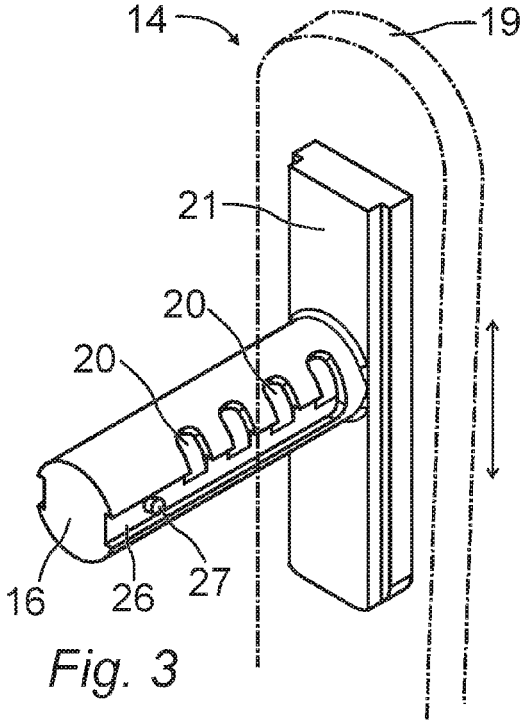
FIG. 3 is a schematic perspective view showing butt plate in a withdrawn position.
Figure 5:
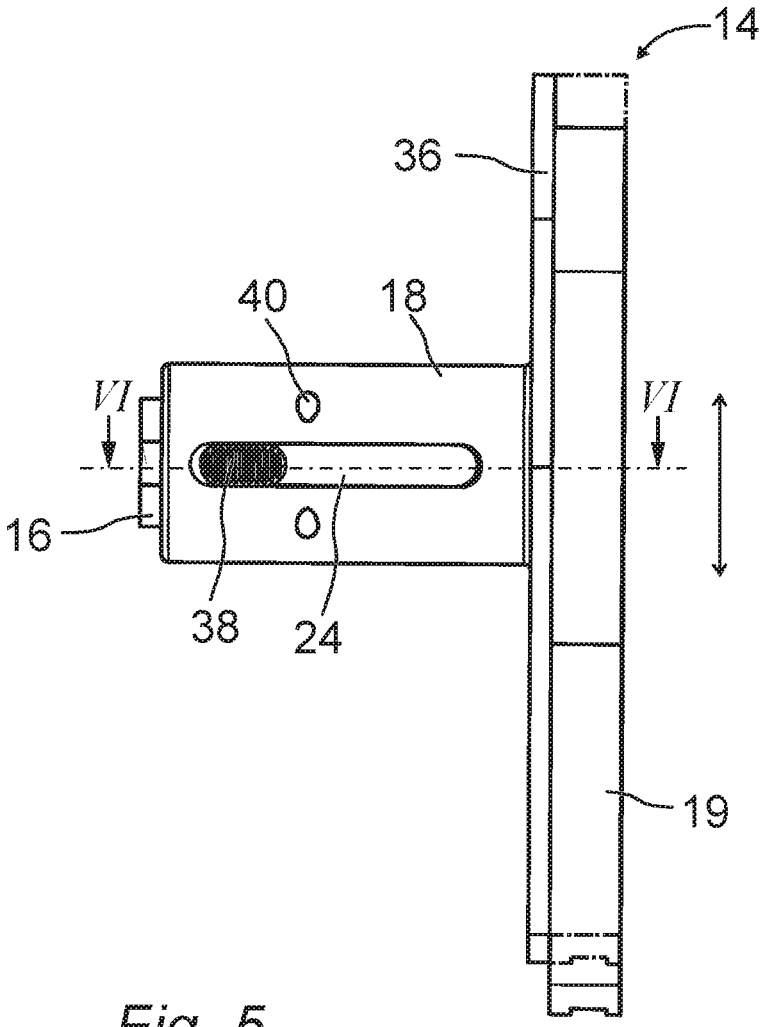
FIG. 5 is a schematic side elevation view of the butt pad assembly.

In the embodiment of butt plate 14 shown in FIG. 3 there are provided two axially extending grooves 26 in diagonally opposite directions in butt plate shaft 16. One of said axially extending grooves 26 will interact with spring-biased locking lever 24. In various embodiments, a stop pin 27 extends radially from butt plate shaft 16 and will prevent a complete withdrawal of butt plate shaft 16 from mounting tube 18. Stop pin 27 extends into axially extending groove 26. Butt plate 14 comprises a shaft support plate 21. Butt plate shaft 16 extends perpendicularly from shaft support plate 21. In various embodiments, butt plate rear part 19 can be vertically adjusted to shaft support plate 21, c.f. FIG. 5 below.

Figure 4:
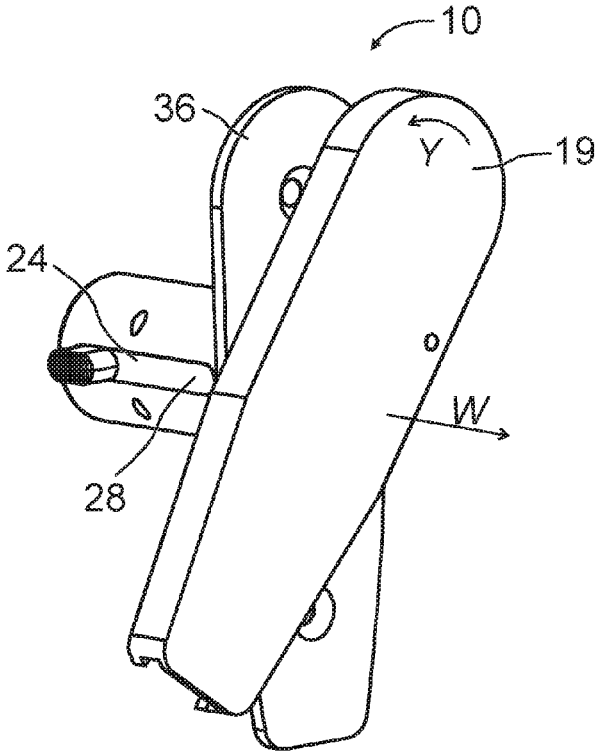
FIG. 4 is a schematic perspective view showing the butt pad assembly in compressed position with a butt plate rotated to a released position.

In the position shown in FIG. 4 butt plate 14 engages plate 36 and is rotated to a released position. In the rotated and released position it is possible to withdraw butt plate 14 in the direction of arrow W corresponding to axial direction X. When a desired extension of the butt plate is reached the butt plate 14 is rotated in the direction of arrow Y until head 28 of spring-biased locking lever 24 is pressed down into axially extending groove (not shown in FIG. 4). In the depressed position head 28 of spring-biased locking lever 24 will prevent further rotation of butt plate 14. After rotation of the butt plate 14 to the locked position lug 22 received in a locking notch 20 will prevent any axial displacement of butt plate 14 and butt plate shaft 16.

In FIG. 5 and FIG. 6 the butt plate shaft 16 is in a locked position and the butt plate 14 is engaging the plate 36. As indicated in FIG. 5 butt plate rear part 19 can be vertically displaced in relation to butt plate shaft 16. Mounting tube 18 extends perpendicularly from plate 36 with butt plate shaft 16 extending concentrically within mounting tube 18. Spring based locking lever 24 remains in a locked position until knob 38 is depressed because of the force produced by spring 42. When knob 38 is depressed, spring-biased locking lever 24 rotates around pin 40 as indicated by arrow R and head 28 of spring based locking lever 24 is moved out of axially extending groove 26. All locking notches 20 in butt plate shaft 16 are open in the shown position of butt plate shaft 16.

Figure 7:
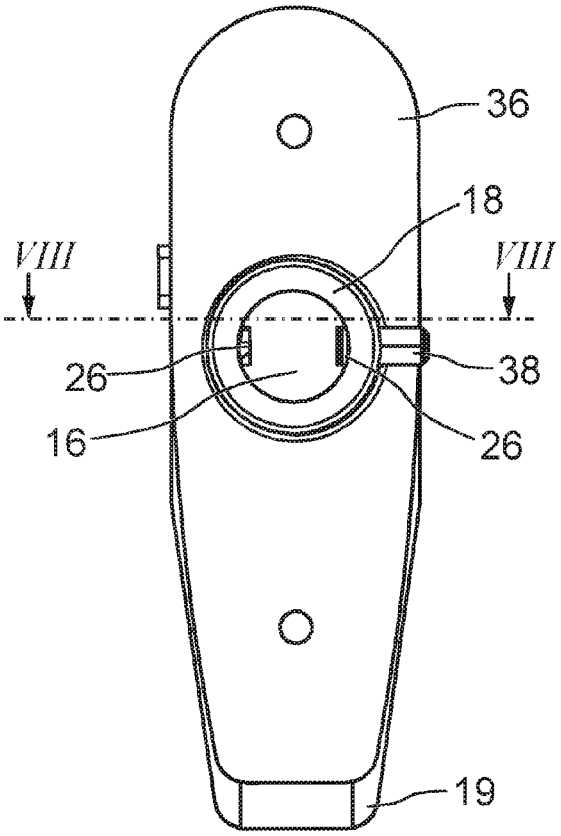
FIG. 7 is a front view of the butt pad assembly.
Figure 8:
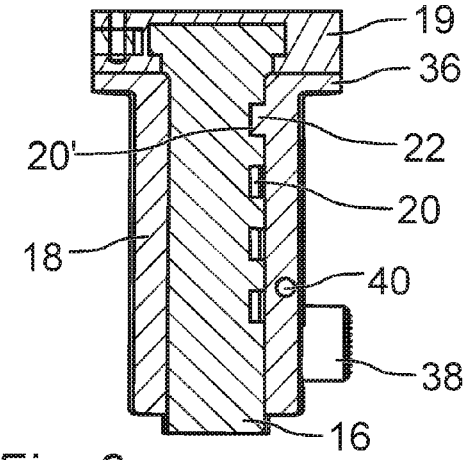
FIG. 8 is a cross-section view of the butt pad assembly with a spring-biased locking lever in locked position taken along line VIII-VIII in FIG. 7.

FIG. 7 and FIG. 8 show butt pad assembly 10 with plate 36, butt plate rear part 19 and knob 38. As indicated in FIG. 7 butt plate rear part 19 is somewhat axially displaced in relation to plate 36. In FIG. 8 one internal and radially extending locking lug 22 is shown received in a first locking notch 20'. Locking lug 22 will be received in another locking notch 20 after releasing and axially displacing butt plate shaft 16 in mounting tube 18. In various embodiments, two axially extending grooves 26 are formed diagonally opposite to each other in butt plate shaft 16. Butt plate shaft 16 extends in axial alignment with mounting tube 18.

Figure 9:
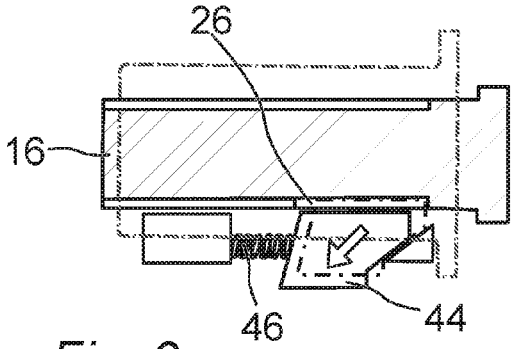
FIG. 9 is a schematic side elevation view of elements of the butt pad assembly comprising a first alternative embodiment of a locking mechanism.

The first alternative embodiment of a locking mechanism shown in FIG. 9 comprises a sliding body 44 that is spring-biased by biasing spring 46 to a locked position shown in dash-and-dot lines. In the locked position sliding body 44 is received in axially extending groove 26 in butt plate shaft 16. Release of the locking mechanism is achieved by sliding said sliding body 44 to the position shown in FIG. 9 in which butt plate shaft 16 can be rotated.

Figure 10:
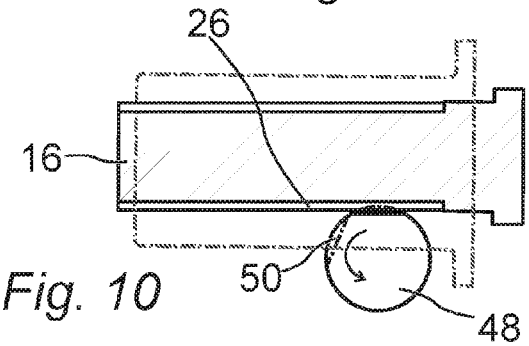
FIG. 10 is a schematic side elevation view of elements of the butt pad assembly comprising a second alternative embodiment of a locking mechanism.

The second alternative embodiment of a locking mechanism shown in FIG. 10 comprises a rotating body 48 biased to the position shown in dash-and-dot lines. Rotating body 48 is formed with a peripheral bevel 50. In the locked position, a peripheral section of rotating body 48 is received in axially extending groove 26 in butt plate shaft 16. Release of the locking mechanism is achieved by rotating said rotating body 48 to the position shown in FIG. 10 in which said bevel is facing axially extending groove 26 and butt plate shaft 16 can be rotated.

It should be noted that the locking mechanism in all embodiments shown and described above is not exposed to any forces in direction X, neither at recoil nor when the butt pad of the firearm strikes against a surface or an object. Any forces in direction X instead are picked up by locking lugs 22 and locking notches 20.

Figure 11:
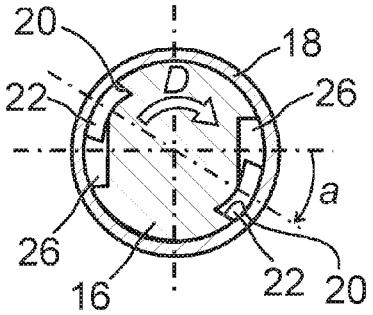
FIG. 11 is a schematic cross-section view showing possible rotation of a butt plate shaft in a mounting tube.
Figure 12:
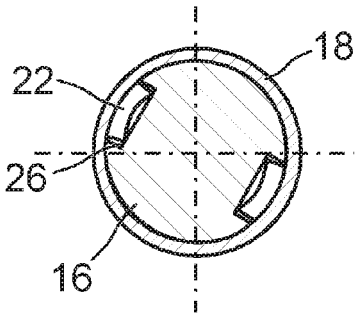
FIG. 12 is a schematic cross-section view showing position of a butt plate shaft in a mounting tube after rotation from position in FIG. 11.

FIG. 11 shows butt plate shaft 16 in locked position with internal and radially extending locking lugs 22 in engagement with locking notches 20. Some part of locking lugs 22 are received in axially extending grooves 26. In the position of butt plate shaft 16 shown in FIG. 11 no axial movement in mounting tube 18 is possible. After rotation in direction D to a position as shown in FIG. 12 internal and radially extending locking lugs 22 are no longer in engagement with locking notches 20. Instead they are received in axially extending grooves 26. In this position, butt plate shaft 16 is axially displaceable.

Figure 13:
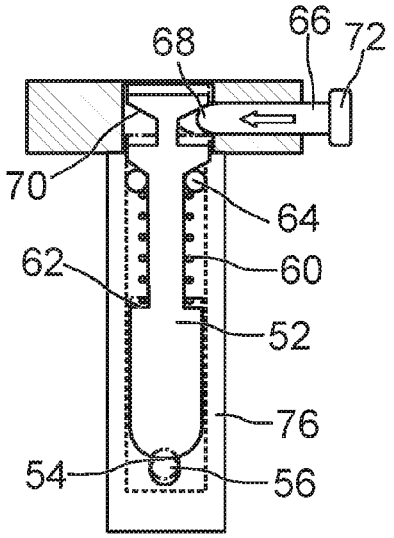
FIG. 13 is a schematic partly cross-section view showing a third alternative embodiment of a locking mechanism.
Figure 14:
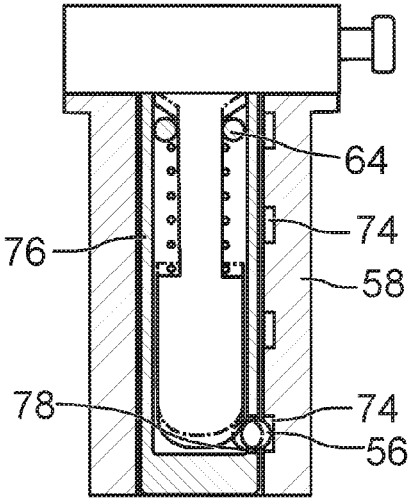
FIG. 14 is a schematic side elevation view showing the third alternative embodiment of a locking mechanism.

A third alternative embodiment of a locking mechanism shown in FIG. 13 and FIG. 14 comprises a spring-biased piston 52 operating between a first locked position where a tip 54 of the piston presses a ball 56 through an aperture 78 in butt plate shaft 76. In this position the ball 56 is received in axially extending groove, or one of a plurality of holes 74 formed in mounting tube 58 and prevents rotation of butt plate shaft 16. Spring-biased piston 52 is biased by a spring 60 extending externally of a central section of spring-biased piston and engaging at a first end a flange 62 and at a second end a stop member 64. A control member 66 having a curved front end 68 engages an inclined section of a bottom end 70 of spring-biased piston 52. Pressing on a head 72 of control member 66 will force spring-biased piston 52 against action of spring 60 to release pressure on ball 56 and to allow ball 56 to fall back through hole 74. In this fallback position ball 56 will no longer be received in groove or hole 74 but will allow rotation and axial displacement of butt plate shaft 76 within mounting tube 58. As in other embodiments locking mechanism shown in FIG. 13 and FIG. 14 will only at least one internal and radially extending locking lug 22 will be received in one of a plurality of locking notches 20 in butt plate shaft 76.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the novel butt pad may be embodied in other forms, structures, arrangements, proportions, sizes, and with other elements, materials, and components, without departing from the spirit or essential characteristics thereof In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A length adjustable butt pad assembly for a firearm, the length adjustable butt pad assembly comprising:

a butt plate having an elongated butt plate shaft comprising a plurality of axially displaced and peripherally extending locking notches and an axially extending groove;

a butt plate base comprising an elongated mounting tube extending in a horizontal direction and receiving said elongated butt plate shaft, wherein said elongated butt plate shaft is rotatable in said elongated mounting tube between a first locked position and a second released position, said second released position allowing an axial displacement of said elongated butt plate shaft between at least two fixed locations.

2. The butt pad assembly according to claim 1, wherein said axially displaced and peripherally extending locking notches are open to said axially extending groove.

3. The butt pad assembly according to claim 1, wherein said elongated butt plate shaft comprises at least three axially displaced and peripherally extending locking notches.

4. The butt pad assembly according to claim 1, wherein said elongated mounting tube comprises at least one internal and radially extending locking lug configured to be received in one of said locking notches in said first locked position.

5. The butt pad assembly according to claim 4, wherein said at least one internal and radially extending locking lug is configured to be received in said axially extending groove in said second released position.

6. The butt pad assembly according to claim 4, wherein two axially extending grooves are formed in said elongated butt plate shaft at opposite positions and two internal and radially extending locking lugs are provided in said elongated mounting tube at opposite positions to fit in said axially extending grooves in said second released position.

7. The butt pad assembly according to claim 1, wherein a locking mechanism is arranged to maintain said elongated butt plate shaft in said first locked position until operated to release said elongated butt plate shaft for optional rotation.

8. The butt pad assembly according to claim 7, wherein said locking mechanism comprises a spring-biased piston having a tip engaging a ball to maintain said ball in a locked position extending through an aperture in said elongated butt plate shaft and being received in one of a plurality of holes in said elongated mounting tube, and wherein pressure against said spring-biased piston releases said ball from said locked position.

9. The butt pad assembly according to claim 7, wherein said locking mechanism comprises a spring-biased locking lever comprising a head that is biased to be received in an axially extending groove formed in said elongated butt plate shaft.

10. The butt pad assembly according to claim 9, wherein said spring-biased locking lever is rotatable around a pin extending in a direction perpendicular to an axial displacement direction of said elongated butt plate shaft.

11. A length adjustable butt pad assembly for a firearm, the length adjustable butt pad assembly comprising:

a butt plate having an elongated butt plate shaft;

a butt plate base comprising an elongated mounting tube extending in a horizontal direction and receiving said elongated butt plate shaft, wherein said elongated butt plate shaft is rotatable in said elongated mounting tube between a first locked position and a second released position, wherein a locking mechanism comprising a spring-biased locking lever comprising a head that is biased to be received in an axially extending groove formed in said elongated butt plate shaft is arranged to maintain said elongated butt plate shaft in said first locked position until operated to release said elongated butt plate shaft for optional rotation, and wherein said second released position allows an axial displacement of said elongated butt plate shaft between at least two fixed locations.

12. A length adjustable butt pad assembly for a firearm, the length adjustable butt pad assembly comprising:

a butt plate having an elongated butt plate shaft;

a butt plate base comprising an elongated mounting tube extending in a horizontal direction and receiving said elongated butt plate shaft, wherein said elongated butt plate shaft is rotatable in said elongated mounting tube between a first locked position and a second released position, wherein a locking mechanism is arranged to maintain said elongated butt plate shaft in said first locked position until operated to release said elongated butt plate shaft for optional rotation, said locking mechanism comprising a spring-biased piston having a tip engaging a ball to maintain said ball in a locked position extending through an aperture in said elongated butt plate shaft and being received in one of a plurality of holes in said elongated mounting tube, wherein pressure against said spring-biased piston releases said ball from said locked position, and wherein said second released position allows an axial displacement of said elongated butt plate shaft between at least two fixed locations.

* * * * *